US010017367B2

(12) United States Patent
Kato et al.

(10) Patent No.: US 10,017,367 B2
(45) Date of Patent: Jul. 10, 2018

(54) INDUSTRIAL VEHICLE

(71) Applicant: KABUSHIKI KAISHA TOYOTA JIDOSHOKKI, Kariya-shi, Aichi-ken (JP)

(72) Inventors: Norihiko Kato, Kariya (JP); Yukikazu Koide, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 462 days.

(21) Appl. No.: 14/664,088

(22) Filed: Mar. 20, 2015

(65) Prior Publication Data

US 2015/0274497 A1 Oct. 1, 2015

(30) Foreign Application Priority Data

Mar. 26, 2014 (JP) ..... 2014-064796

(51) Int. Cl.
*F15B 13/04* (2006.01)
*B66F 9/22* (2006.01)
*F15B 20/00* (2006.01)

(52) U.S. Cl.
CPC ..... *B66F 9/22* (2013.01); *F15B 13/0417* (2013.01); *F15B 20/007* (2013.01)

(58) Field of Classification Search
CPC ..... F15B 15/24; F15B 15/202; F15B 9/08; F15B 11/163; F15B 13/026; F15B 2211/40553; F15B 2211/40561; F15B 2211/40569; F15B 2211/465; B66F 9/22
See application file for complete search history.

(56) References Cited

U.S. PATENT DOCUMENTS 9,181,070 B2 * 11/2015 Sugano ..... B66D 1/44
2006/0060409 A1 3/2006 Dammeyer et al.
2006/0175118 A1 * 8/2006 Hirakushi ..... B62D 5/065 180/422
2007/0210645 A1 9/2007 Dornbach

FOREIGN PATENT DOCUMENTS

JP 2012-062137 A 3/2012

OTHER PUBLICATIONS

Communication dated Jul. 30, 2015, issued by the European Patent Office in corresponding European Application No. 15160459.2.

* cited by examiner

*Primary Examiner* — F. Daniel Lopez
*Assistant Examiner* — Abiy Teka
(74) *Attorney, Agent, or Firm* — Sughrue Mion, PLLC

(57) ABSTRACT

An industrial vehicle includes an engine, a hydraulic pump, a hydraulic operation device, a supply passage, a drainage passage, an unloading valve that connects the supply passage and the drainage passage to each other, and a controller that controls open/closed state of the unloading valve. If an on-load period at the time of application of load on the engine is less than a first predetermined time, the controller performs open/close control of causing the unloading valve to enter the closed state to set an on-load state, thereby increasing pressure of hydraulic oil passing through the supply passage and then causing the unloading valve to enter the open state.

3 Claims, 5 Drawing Sheets

INDUSTRIAL VEHICLE

BACKGROUND OF THE INVENTION

The present invention relates to an industrial vehicle including a hydraulic operation device.

An industrial vehicle includes an engine and a hydraulic pump driven by the engine. Hydraulic oil discharged from the hydraulic pump activates a hydraulic operation device. An example of a known industrial vehicle includes a forklift. A forklift includes, for example, a hydraulic cylinder for lifting, which is a hydraulic operation device that moves up and down the fork, and a hydraulic cylinder for tilting, which is a hydraulic operation device that tilts the mast. When the hydraulic pump is driven by the engine, an engine stall may occur when the torque of the engine becomes insufficient due to an increase in the load of the hydraulic pump. Therefore, a configuration for preventing the occurrence of an engine stall is conventionally proposed. For example, see Japanese Laid-Open Patent Publication No. 2012-62137.

There is room for improvement in the configuration for preventing the occurrence of an engine stall when an electromagnetic valve is adopted as a control valve for controlling the supply and drainage of hydraulic oil to and from a hydraulic operation device in an industrial vehicle such as a forklift including the hydraulic operation device.

SUMMARY OF THE INVENTION

An objective of the present invention is to provide an industrial vehicle that prevents the occurrence of engine stalls.

To achieve the foregoing objective and in accordance with one aspect of the present invention, an industrial vehicle is provided that includes an engine, a hydraulic pump driven by the engine, a hydraulic operation device operated by oil pressure, a connection passage that connects the hydraulic pump and the hydraulic operation device to each other, an electromagnetic control valve that is connected to the connection passage and controls supply and drainage of hydraulic oil to and from the hydraulic operation device, a supply passage through which the hydraulic oil supplied to the hydraulic operation device flows, a drainage passage through which the hydraulic oil drained to an oil tank flows, an unloading valve that connects the supply passage and the drainage passage to each other, a relief valve that is connected to the supply passage and operated by pressure of the hydraulic oil flowing through the supply passage, and a controller that controls open/closed state of the unloading valve. If an on-load period at the time of application of load on the engine is less than a first predetermined time, the controller performs open/close control of causing the unloading valve to enter the closed state to set an on-load state, thereby increasing the pressure of the hydraulic oil passing through the supply passage and then causing the unloading valve to enter the open state.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An industrial vehicle according to one embodiment will now be described with reference to FIGS. 1 to 7.

Figure 1:
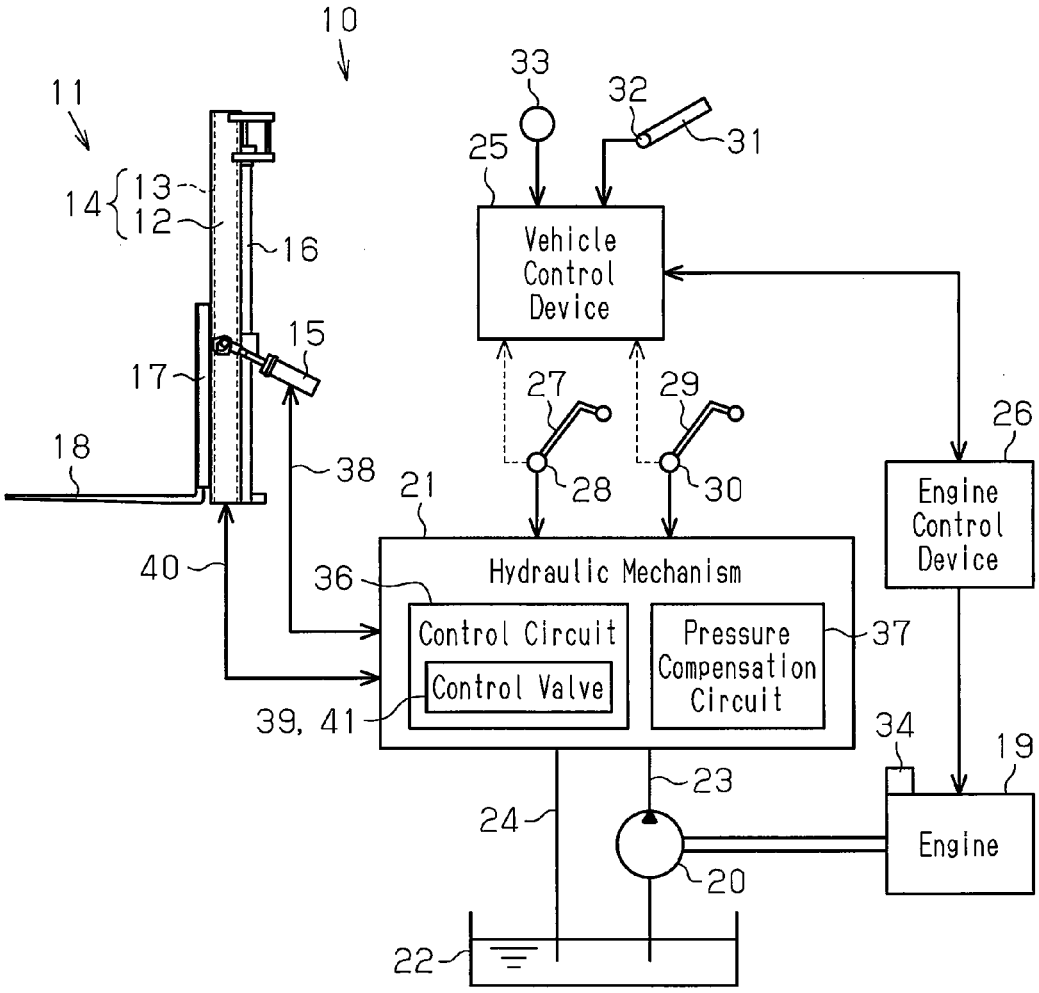
FIG. 1 is a schematic diagram showing an overall configuration of a forklift.

As shown in FIG. 1, the body of a forklift 10 as an industrial vehicle is equipped with a cargo handling device 11. The cargo handling device 11 includes a multistage mast 14, which includes right and left outer rails 12 and right and left inner rails 13. A hydraulic tilt cylinder 15 as a hydraulic operation device is connected to the outer rails 12. A hydraulic lift cylinder 16 as a hydraulic operation device is connected to the inner rails 13.

The mast 14 inclines forward and backward in the front-back direction of the body through supply and drainage of hydraulic oil to and from the tilt cylinder 15. The inner rails 13 rise and fall in the vertical direction of the body through supply and drainage of hydraulic oil to and from the lift cylinder 16.

The inner rails 13 are provided with a fork 18 as a cargo handling tool via a lift bracket 17. The operation of the lift cylinder 16 moves up and down the inner rails 13 along the outer rails 12, and thus the fork 18 moves up and down along with the lift bracket 17.

The body of the forklift 10 is equipped with an engine 19, a hydraulic pump 20, and a hydraulic mechanism 21. The engine 19 is a driving source of traveling operation and cargo handling operation of the forklift 10. The hydraulic pump 20 is driven by the engine 19. The hydraulic mechanism 21 receives supply of hydraulic oil discharged from the hydraulic pump 20. The hydraulic mechanism 21 controls supply and drainage of the hydraulic oil to and from the cylinders 15 and 16.

An oil passage 23 for supplying the hydraulic oil pumped up from an oil tank 22 to the hydraulic mechanism 21 is connected to the hydraulic pump 20. The oil passage 23 is connected to a discharge port of the hydraulic pump 20. A drainage passage 24 for the hydraulic oil drained to the oil tank 22 is connected to the hydraulic mechanism 21.

A vehicle control device 25 as a controller and an engine control device 26 are mounted on the body of the forklift 10. The engine control device 26 is electrically connected to the vehicle control device 25.

The forklift 10 includes a tilt manipulation member 27 as an instruction member that instructs operation of the tilt cylinder 15 and a lift manipulation member 29 as an instruction member that instructs operation of the lift cylinder 16. A tilt sensor 28 that detects the operation state of the tilt manipulation member 27 is provided on the tilt manipulation member 27. A lift sensor 30 that detects the operation state of the lift manipulation member 29 is provided on the lift manipulation member 29. The tilt sensor 28 and the lift sensor 30 are electrically connected to the vehicle control device 25.

The forklift 10 includes an accelerator manipulation member 31 that instructs acceleration of the forklift 10 through operation by the driver, an accelerator sensor 32 that detects the accelerator opening corresponding to the amount of manipulation of the accelerator manipulation member 31, and a driver detection sensor 33 that detects the presence or absence of the driver. The accelerator sensor 32 and the driver detection sensor 33 are electrically connected to the vehicle control device 25.

The tilt manipulation member 27, the lift manipulation member 29, and the accelerator manipulation member 31 are arranged in the cab of the forklift 10. The driver detection sensor 33 is arranged in, for example, the driver's seat.

The vehicle control device 25 detects whether the driver is at the correct driving operation position based on a detection result of the driver detection sensor 33. The vehicle control device 25 restricts the operation of the forklift 10 when the vehicle control device 25 detects that the driver is not at the correct driving operation position. The operations to be restricted include the cargo handling operation and the traveling operation.

The vehicle control device 25 outputs a command regarding the rotation speed of the engine 19 to the engine control device 26 to control the engine rotation speed. The engine control device 26 controls the engine 19 based on the input command regarding the rotation speed. The engine control device 26 outputs the actual rotation speed of the engine 19 detected by a rotation speed sensor 34 to the vehicle control device 25.

In the forklift 10, in which the hydraulic pump 20 is driven by the engine 19, the corresponding cylinders 15 and 16 are operated by stepping on the accelerator manipulation member 31 and manipulating the manipulation members 27 and 29.

The configuration of the hydraulic mechanism 21 will now be described.

The hydraulic mechanism 21 includes a control circuit 36 that controls the supply and drainage of the hydraulic oil and a pressure compensation circuit 37 that compensates the pressure in the hydraulic mechanism 21.

The control circuit 36 includes a control valve 39 connected to the oil chamber of the tilt cylinder 15 through an oil passage 38 and a control valve 41 connected to the oil chamber of the lift cylinder 16 through an oil passage 40. The control valves 39 and 41 are connected to the oil passage 23 and the drainage passage 24. In the present embodiment, the passages 23, 38, and 40 form connection passages for connecting the hydraulic pump 20 and the hydraulic operation device (tilt cylinder 15 and lift cylinder 16) to each other. The control valves 39 and 41 for controlling the supply and drainage of the hydraulic oil to and from the hydraulic operation device (tilt cylinder 15 and lift cylinder 16) are connected to the connection passages.

The control valves 39 and 41 are electromagnetic switching valves. The open/closed state of the control valve 39 is switched by electrical signals from the vehicle control device 25, which has detected the operation of the tilt manipulation member 27. The open/closed state of the control valve 41 is switched by electrical signals from the vehicle control device 25, which has detected the operation of the lift manipulation member 29.

The hydraulic oil discharged from the hydraulic pump 20 flows to the control valves 39 and 41 through the oil passage 23 and is supplied to the oil chambers of the cylinders 15 and 16 through the oil passages 38 and 40. For example, when the tilt manipulation member 27 is manipulated, the hydraulic oil discharged from the hydraulic pump 20 is supplied to the oil chamber of the tilt cylinder 15 through the oil passage 38 connected to the control valve 39. The hydraulic oil drained from the oil chambers of the cylinders 15 and 16 is drained to the oil tank 22 through the drainage passage 24.

The pressure compensation circuit 37 will now be described with reference to FIGS. 2 to 4.

The pressure compensation circuit 37 includes a first supply passage 45 connected to the hydraulic operation device (the tilt cylinder 15 and the lift cylinder 16). The first supply passage 45 introduces sensing pressure of the cylinders 15 and 16 to the pressure compensation circuit 37. The first supply passage 45 corresponds to a supply passage through which the hydraulic oil supplied to the hydraulic operation device flows. The first supply passage 45 is connected to the drainage passage 24.

The pressure compensation circuit 37 includes a second supply passage 46 branched from a branch section P1 of the connection passage including the oil passage 23. The second supply passage 46 is connected to the oil passage 23. The second supply passage 46 corresponds to a supply passage through which the hydraulic oil supplied to the hydraulic operation device flows. The second supply passage 46 is connected to the first supply passage 45 at a connection section P2 in the middle of the first supply passage 45.

In the first supply passage 45, the side connected to the cylinders 15 and 16 will be defined as an upstream side, and the side connected to the drainage passage 24 will be defined as a downstream side. A check valve 47, a relief valve 48, a filter 49, and an unloading valve 50 are sequentially connected to the first supply passage 45, from the upstream side to the downstream side.

A predetermined operating pressure is set for the relief valve 48. The unloading valve 50 is an electromagnetic valve that is switched between an open state and a closed state. The vehicle control device 25 controls ON/OFF of the solenoid of the unloading valve 50.

Figure 2:
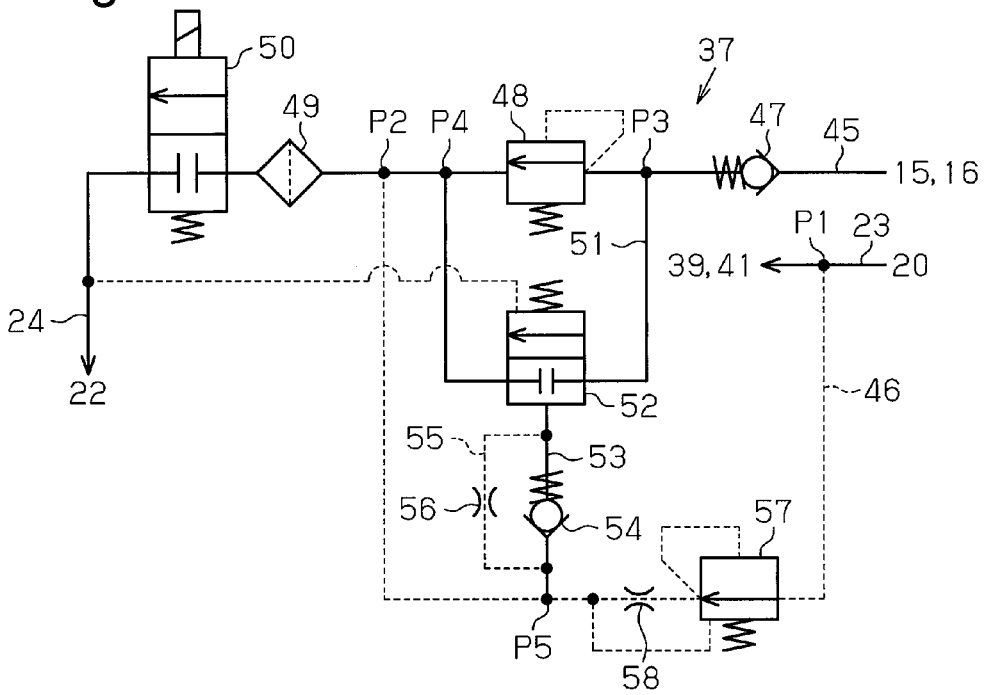
FIG. 2 is a hydraulic circuit diagram showing a pressure compensation circuit including an unloading valve.

In the pressure compensation circuit 37 of the present embodiment, the drainage passage 24 and the first supply passage 45 are not connected to each other when the unloading valve 50 is in the closed state as shown in FIG. 2. More specifically, the drainage passage 24 and the first supply passage 45 are not fluidly connected to each other in this case. The drainage passage 24 and the first supply passage 45 are connected to each other when the unloading valve 50 is in the open state as shown in FIGS. 3 and 4. More specifically, the drainage passage 24 and the first supply passage 45 are fluidly connected to each other in this case. The unloading valve 50 is a valve for connecting the first supply passage 45, which is a supply passage, and the drainage passage 24 to each other.

A branched passage 51 branched from the first supply passage 45 is connected to the first supply passage 45. The branched passage 51 is connected to a connection section P3 between the relief valve 48 and the check valve 47 and to a connection section P4 between the relief valve 48 and the filter 49. As a result, the hydraulic oil can pass through the branched passage 51 to bypass the relief valve 48. An on-off valve 52 is connected to the branched passage 51. The on-off valve 52 is switched between an open state and a closed state and is driven by spring force. The on-off valve 52 opens and closes the branched passage 51.

An oil passage 53 is connected between the on-off valve 52 and a connection section P5 of the second supply passage 46. A check valve 54 is connected to the oil passage 53 to allow the hydraulic oil to flow from the second supply passage 46 to the on-off valve 52. An oil passage 55 branched to bypass the check valve 54 is connected to the oil passage 53. An orifice 56 is connected to the oil passage 55.

When the unloading valve 50 is in the closed state as shown in FIG. 2, the pressure against the spring force is provided to the on-off valve 52 through the first supply passage 45, the second supply passage 46, and the oil passage 53 (check valve 54), and thus the on-off valve 52 enters the closed state. More specifically, the check valve 54 provides the pressure of the second supply passage 46 to the on-off valve 52 when the unloading valve 50 is in the closed state.

Figure 3:
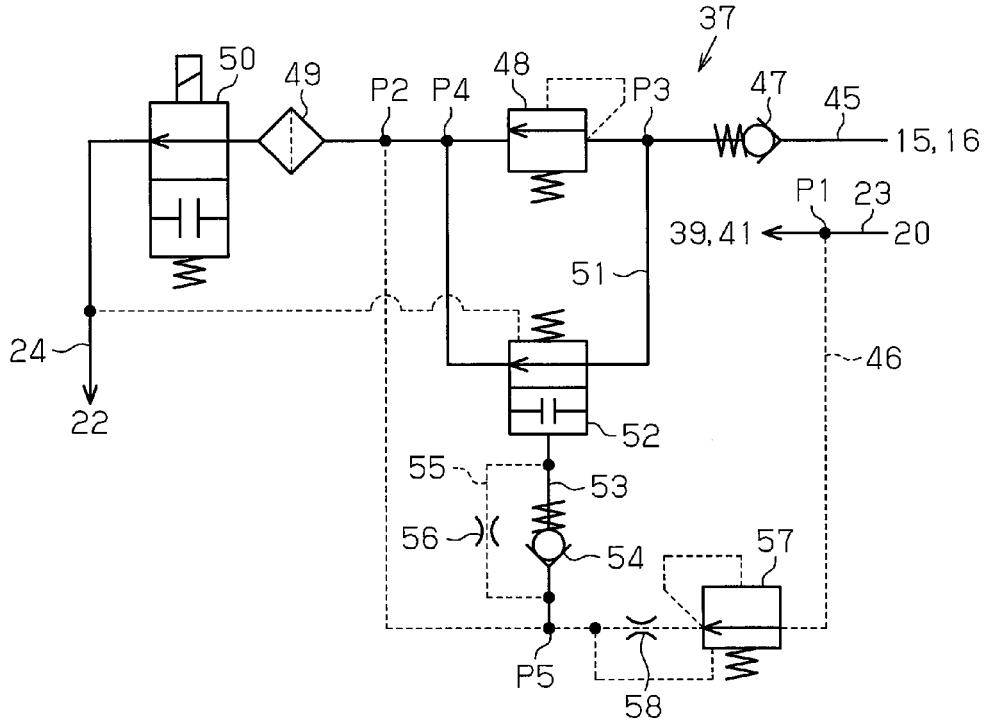
FIG. 3 is a hydraulic circuit diagram showing a pressure compensation circuit in an unloading state.
Figure 4:
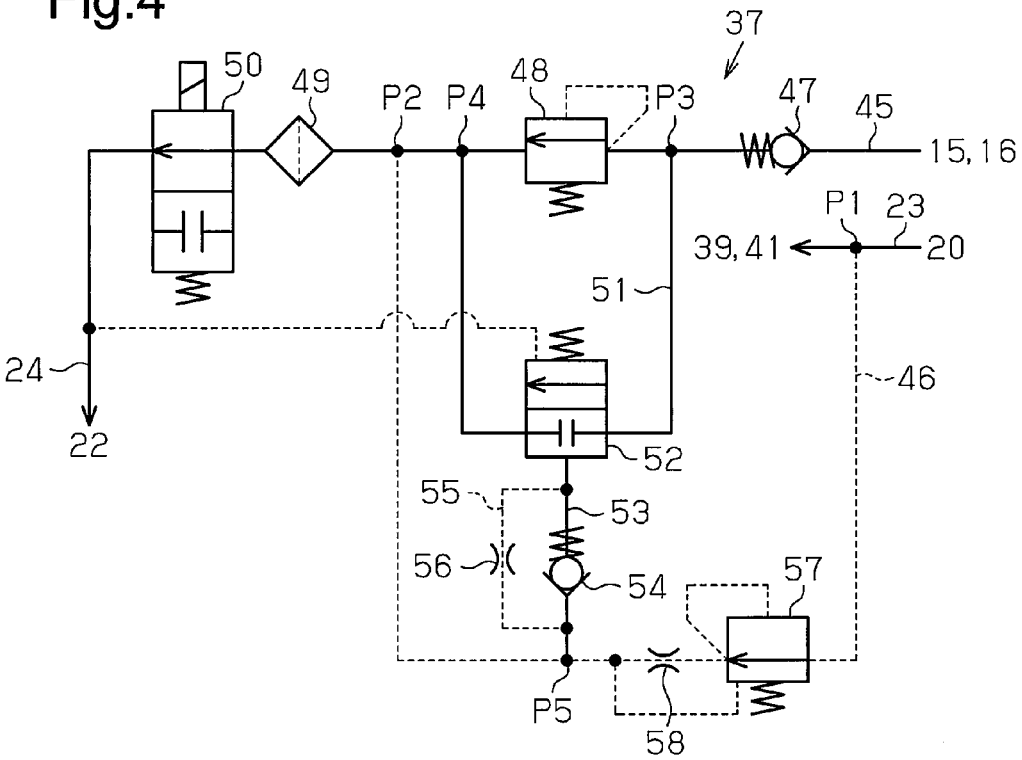
FIG. 4 is a hydraulic circuit diagram showing the pressure compensation circuit, in which the unloading valve is in an open state, and an on-off valve is in a closed state.

In contrast, the pressure provided through the first supply passage 45, the second supply passage 46, and the oil passage 53 (check valve 54) drops when the unloading valve 50 is in the open state as shown in FIGS. 3 and 4, and thus the on-off valve 52 operates to enter the open state.

When the on-off valve 52 is in the open state as shown in FIG. 3, the orifice 56 of the oil passage 55 releases the pressure provided to the on-off valve 52 to the first supply passage 45 through the second supply passage 46. A pressure reducing valve 57 and an orifice 58 are further connected to the second supply passage 46, between the branch section P1 and the connection section P5.

Operation of the hydraulic mechanism 21, which is mounted on the forklift 10 of the present embodiment, will now be described with reference to FIGS. 2 to 7.

FIG. 2 shows the pressure compensation circuit 37 in an on-load state. In the on-load state, the unloading valve 50 is controlled to be in the closed state, and the pressure of the oil passage 23 is not released to the drainage passage 24. Therefore, the hydraulic oil discharged from the hydraulic pump 20 flows to the tilt cylinder 15 and the lift cylinder 16 through the control valves 39 and 41. Thus, the pressure compensation circuit 37 can be in the state of FIG. 2 during normal cargo handling operation. The on-off valve 52 can be in the closed state due to the pressure provided through the first supply passage 45, the second supply passage 46, and the oil passage 53 (the check valve 54).

FIG. 3 shows the pressure compensation circuit 37 in an unloading state. In the unloading state shown in FIG. 3, the unloading valve 50 is controlled to be in the open state, and the on-off valve 52 is controlled to be in the open state. Therefore, the pressure of the oil passage 23, the first supply passage 45, and the second supply passage 46 is released to the drainage passage 24. As a result, the pressure in the hydraulic mechanism 21 including the pressure compensation circuit 37 is released to the drainage passage 24 in this state, and the pressure is not provided to the tilt cylinder 15 or the lift cylinder 16. The control valves 39 and 41 are formed by electromagnetic switching valves in the forklift 10 of the present embodiment, and thus the pressure compensation circuit 37 can be in the unloading state shown in FIG. 3 when the cargo handling operation is not performed.

The load of the hydraulic pump 20 rapidly increases along with the activation of the hydraulic operation device when the cargo handling operation is performed in a state in which the pressure in the hydraulic mechanism 21 is low, that is, in a no-load state, such as when the engine 19 is controlled at idle rotation speed without the operation of the accelerator manipulation member 31. An engine stall may occur when the torque of the engine 19 becomes insufficient along with the increase in the load of the hydraulic pump 20. Therefore, the vehicle control device 25 of the present embodiment performs control for preventing an engine stall in a situation where a rapid load change can occur in the engine 19.

The cargo handling operation includes operation of the tilt cylinder 15 and operation of the lift cylinder 16. The cargo handling operation is load operation in which load is applied to the engine 19. The vehicle control device 25 permits the cargo handling operation when it is detected that the driver is at the correct driving operation position based on the detection result of the driver detection sensor 33. This is a state in which the operation of the tilt cylinder 15 and the lift cylinder 16 is permitted.

In the present embodiment, the vehicle control device 25 prevents an engine stall by suppressing the rapid rise in the pressure in the hydraulic mechanism 21 when the cargo handling operation is performed. Specifically, the vehicle control device 25 discretely increases the pressure in the hydraulic mechanism 21 to suppress a rapid rise in the pressure. The cargo handling operation refers to operation of the tilt manipulation member 27 and/or the lift manipulation member 29.

Figure 6:
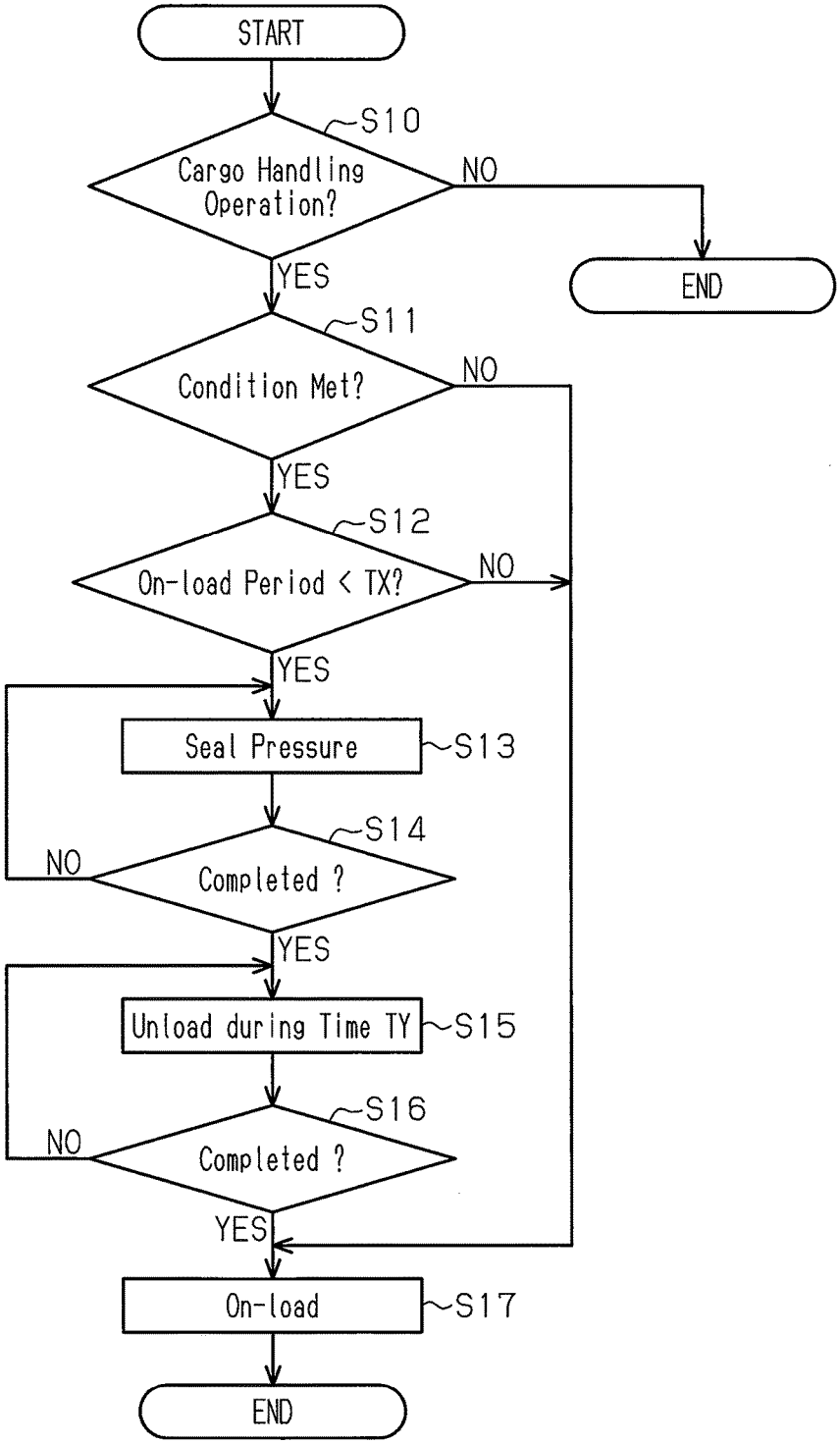
FIG. 6 is an explanatory flowchart showing a process for stating the cargo handling operation.

Hereinafter, control performed by the vehicle control device 25 to prevent an engine stall will be described with reference to FIG. 6.

The vehicle control device 25 determines whether the cargo handling operation has been performed based on the detection results of the tilt sensor 28 and the lift sensor 30 (step S10). The vehicle control device 25 makes a positive determination in step S10 when the cargo handling operation has been performed in the case in which the cargo handling operation is permitted based on the detection result of the driver detection sensor 33.

In contrast, the vehicle control device 25 makes a negative determination in step S10 to end the process when the cargo handling operation has not been performed, when the cargo handling operation is not permitted based on the detection result of the driver detection sensor 33, or when another cargo handling operation is detected in a state in which a cargo handling operation has already been detected. The case in which another cargo handling operation is detected in a state in which a cargo handling operation has already been detected includes a case in which a plurality of cargo handling operations are performed at the same time, such as when operation of the lift manipulation member 29 is detected after the detection of the operation of the tilt manipulation member 27.

After making a positive determination in step S10, the vehicle control device 25 determines whether a condition in which an engine stall easily occurs is met when the cargo handling operation is performed based on the cargo handling operation, that is, when load is applied to the engine 19 (step S11). The condition in which an engine stall easily occurs is, for example, when the engine rotation speed at the detection of the cargo handling operation is relatively low (for example, near the idle rotation speed). When the engine rotation speed is low, the torque of the engine 19 tends to be insufficient due to the increase in the load of the hydraulic pump 20, and as a result, the possibility of the occurrence of an engine stall is high. The vehicle control device 25 makes a positive determination in step S11 when the condition is met. In contrast, the vehicle control device 25 makes a negative determination in step S11 when the condition is not met and causes the unloading valve 50 to enter the closed state in step S17 to control the hydraulic mechanism 21 in the on-load state. In other words, the vehicle control device 25 performs open/close control of causing the unloading valve 50 to enter the closed state to set the on-load state.

When making a positive determination in step S11, the vehicle control device 25 determines whether the on-load period is less than a time TX (for example, several hundred milliseconds) at step S12. The time TX corresponds to a first predetermined time. The on-load period is a period during which the hydraulic mechanism 21 is maintained in the on-load state when the pressure compensation circuit 37 is in the state shown in FIG. 2. A timer incorporated in the vehicle control device 25 measures the on-load period when the hydraulic mechanism 21 enters the on-load state due to the cargo handling operation.

The pressure in the hydraulic mechanism 21 is high when the on-load period is equal to or more than the time TX. More specifically, the cargo handling operation has most recently been performed, and the high pressure is still maintained in the hydraulic mechanism 21. In this case, even if the hydraulic mechanism 21 enters the on-load state based on a new cargo handling operation, a rapid increase in the pressure is unlikely to occur, because the pressure in the hydraulic mechanism 21 is already high. Therefore, the vehicle control device 25 makes a negative determination in step S12 and causes the unloading valve 50 to enter the closed state in step S17 to control the hydraulic mechanism 21 in the on-load state. In other words, the vehicle control device 25 performs open/close control of causing the unloading valve 50 to enter the closed state to set the on-load state.

In contrast, the pressure in the hydraulic mechanism 21 is not high when the on-load period is less than the time TX. Therefore, when the hydraulic mechanism 21 enters the load state based on the cargo handling operation in this state, the pressure in the hydraulic mechanism 21 may rapidly rise, and the torque of the engine 19 may be insufficient. Therefore, the vehicle control device 25 makes a positive determination in step S12 and advances to the next process (step S13) to make the rapid rise in the pressure unlikely to occur.

In step S13, the vehicle control device 25 temporarily causes the hydraulic mechanism 21 to enter the on-load state and seals the pressure in the hydraulic mechanism 21 including the pressure compensation circuit 37. For example, the pressure is released to the drainage passage 24 in the unloading state shown in FIG. 3. A positive determination is made in step S12 when the unloading state continues in this way. Therefore, the vehicle control device 25 causes the unloading valve 50 to enter the closed state and causes the hydraulic mechanism 21 to enter the on-load state as shown in FIG. 2. The vehicle control device 25 maintains the on-load state shown in FIG. 2 until the on-load period reaches the time TX (step S14).

The time during which the on-load state is maintained in step S14 changes according to the on-load period measured by the timer of the vehicle control device 25 in step S12. For example, if the on-load period is zero, the time during which the on-load state is maintained in step S14 is equal to the time TX. For example, if the on-load period is time greater than zero, the time during which the on-load state is maintained in step S14 is time obtained by subtracting the on-load period from the time TX.

This on-load causes the hydraulic oil discharged from the hydraulic pump 20 to flow through the oil passage 23, and thus the pressure of the oil passage 23 rises. The hydraulic oil is supplied to the cylinders 15 and 16 through the control valves 39 and 41, and thus the pressure of the first supply passage 45 also rises.

When making a positive determination in step S14, that is, when sealing the pressure during the time TX, the vehicle control device 25 switches the unloading valve 50 from the closed state to the open state and returns the hydraulic mechanism 21 from the on-load state shown in FIG. 2 to the unloading state shown in FIG. 4 (step S15). In this way, the pressure in the pressure compensation circuit 37 is released to the drainage passage 24. Although the hydraulic oil discharged from the hydraulic pump 20 flows through the oil passage 23, the pressure of the oil passage 23 also drops along with the drop in the pressure of the pressure compensation circuit 37. The hydraulic oil is supplied to the tilt cylinder 15 and the lift cylinder 16 through the control valves 39 and 41, and thus the pressure of the first supply passage 45 rises. The pressure is compensated so that the pressure of the oil passage 23 is slightly higher than the pressure of the first supply passage 45, regardless of the cargo handling operation.

In the pressure compensation circuit 37, the relief valve 48 is opened when the pressure of the first supply passage 45 reaches the operating pressure of the relief valve 48. As a result, the pressure of the first supply passage 45 is released to the drainage passage 24 through the unloading valve 50, and the pressure does not reach or exceed the operating pressure of the relief valve 48. Accordingly, the pressure of the oil passage 23 is maintained at a pressure slightly higher than the pressure of the first supply passage 45. The pressure against the spring force is provided in this state, and thus the on-off valve 52 maintains the closed state.

After setting the unloading state, the vehicle control device 25 maintains this state during a time TY (for example, several hundred milliseconds) at step S16. The time TY corresponds to a second predetermined time. When the elapsed time from the setting of the unloading state reaches the time TY (positive determination in step S16), the vehicle control device 25 causes the unloading valve 50 to enter the closed state to control the hydraulic mechanism 21 in the on-load state (step S17). In other words, when the second predetermined time TY elapses after the vehicle control device 25 causes the unloading valve 50 to enter the open state, the vehicle control device 25 causes the unloading valve 50 to enter the closed state again to set the on-load state.

As a result, the pressure compensation circuit 37 enters the state in which the pressure of the first supply passage 45 is not released to the drainage passage 24 as shown in FIG. 2. Therefore, the pressure compensation circuit 37 cannot release the pressure to the outside of the circuit, and the pressure in the circuit exceeds the operating pressure of the relief valve 48. The pressure of the first supply passage 45 and the pressure of the second supply passage 46 also rise. As a result, the pressure necessary for operating the tilt cylinder 15 and the lift cylinder 16 is supplied to the control valves 39 and 41 through the oil passage 23. In this way, the corresponding cylinders 15 and 16 operate according to the operation of the manipulation members 27 and 29.

Figure 5:
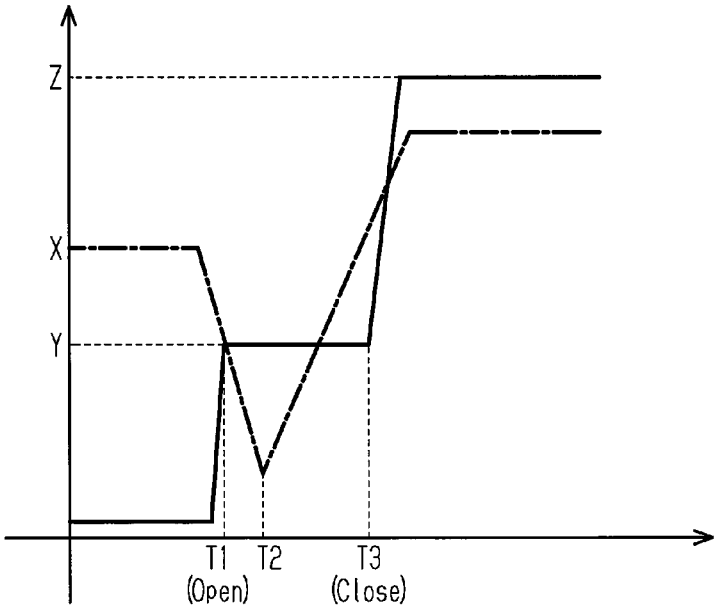
FIG. 5 is a timing chart showing changes in the pressure and the engine rotation speed when a cargo handling operation is started.

FIG. 5 shows changes in the pressure obtained by the control (solid line) and the engine rotation speed (long dashed short dashed line).

When the cargo handling operation is instructed, the drive of the hydraulic pump 20 increases the pressure of the hydraulic mechanism 21, but the engine rotation speed decreases from rotation speed X (for example, idle rotation speed). Therefore, when the unloading valve 50 is switched to the open state ("open" in FIG. 5) as shown in FIG. 4, the pressure rises to pressure Y equal to the operating pressure of the relief valve 48 as described above (time T1 in FIG. 5), and then the pressure Y is maintained. Thus, the temporary stop of the increase in the load of the hydraulic pump 20 prevents an engine stall, and the engine 19 can be restored to increase the engine rotation speed at time T2. Subsequently, when the unloading valve 50 is switched to the closed state ("closed" in FIG. 5) as shown in FIG. 2 at time T3, the pressure rises beyond the operating pressure of the relief valve 48 and reaches pressure Z necessary for operating the cylinders 15 and 16.

The vehicle control device 25 sets the time up to time T3 as the time TY as shown in FIG. 5 and controls the unloading valve 50 to enter the open state. It is preferable that the pressure Y that can be the operating pressure of the relief valve 48 be set to the maximum pressure that prevents an engine stall, and for example, the pressure Y can be calculated by simulation. If the pressure Y is set too high, the possibility of the occurrence of an engine stall increases, as is clear from the changes in the engine rotation speed shown in FIG. 5. In contrast, if the time TY is set too long or if the pressure Y is set too low, the time before the pressure reaches the pressure Z may be long, as is clear from the changes in the pressure shown in FIG. 5. More specifically, if the time before the pressure reaches the pressure Z is long, the time during which the cylinders 15 and 16 do not react after the instruction of the cargo handling operation may be long. To prevent the occurrence of an engine stall, the vehicle control device 25 of the present embodiment opens and closes the unloading valve 50 of the pressure compensation circuit 37 to discretely (in two stages in the present embodiment) increase the pressure as shown in FIG. 5.

Details of control after the cargo handling operation will be described.

When there is no more instruction of the cargo handling operation, the vehicle control device 25 causes the unloading valve 50 to enter the open state to set the unloading state as shown in FIG. 4. As a result, the relief valve 48 is operated to release the pressure of the first supply passage 45 to the drainage passage 24 through the unloading valve 50. Therefore, the pressure of the first supply passage 45 drops.

The pressure of the oil passage 53 is also released to the drainage passage 24 when the unloading valve 50 enters the open state. The pressure of the oil passage 53 provided to the on-off valve 52 is released, and thus the spring force provided to the on-off valve 52 serves as driving force to start switching the on-off valve 52 from the closed state to the open state. The time necessary for the switch is determined by the diameter of the orifice 56. When the on-off valve 52 enters the open state as shown in FIG. 3, the pressure of the first supply passage 45 is released to the drainage passage 24 through the on-off valve 52. The pressure of the oil passage 23 is slightly higher than the first supply passage 45, and thus the release of the pressure of the first supply passage 45 to the drainage passage 24 decreases the pressure of the first supply passage 45. As a result, the pressure provided to the tilt cylinder 15 and the lift cylinder 16 drops. In the present embodiment, the on-off valve 52, the check valve 54, and the orifice 56 form a timer circuit unit that opens the first supply passage 45 based on elapse of time.

Figure 7:
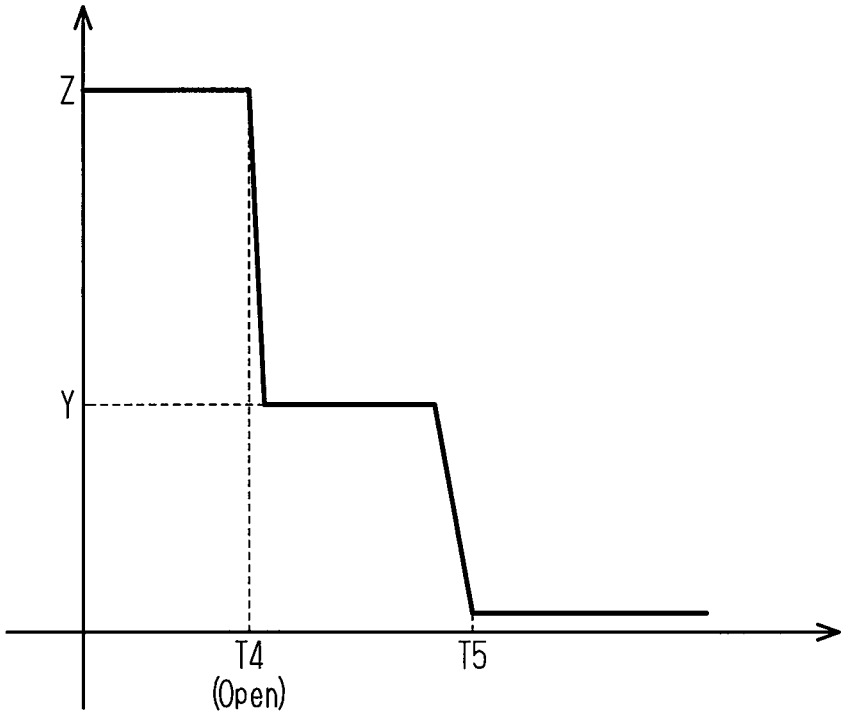
FIG. 7 is a timing chart showing changes in the pressure after the end of the cargo handling operation.

FIG. 7 shows changes in the pressure (solid line) obtained by the control.

As shown in FIG. 7, the vehicle control device 25 controls the unloading valve 50 to enter the open state when there is no more instruction of the cargo handling operation at time T4. As a result, the pressure (pressure Z) provided to the cylinders 15 and 16 is released to the drainage passage 24 through the pressure compensation circuit 37, and the pressure gradually drops. After the pressure provided to the cylinders 15 and 16 reaches the pressure Y, the on-off valve 52 enters the open state. Consequently, the pressure provided to the cylinders 15 and 16 further drops, and the pressure becomes substantially zero at time T5. As a result, the cargo handling operation is restricted even if the cargo handling operation is instructed for some reasons when the driver is not at the correct driving operation position. At the stage where the pressure provided to the cylinders 15 and 16 has reached the pressure Y, the pressure in the hydraulic mechanism 21 is maintained at the pressure Y before the operation of the timer circuit unit. Therefore, if the cargo handling operation is instructed in this stage, a negative determination is made in step S12 of FIG. 6, and the on-load state shown in FIG. 2 is set.

Accordingly, the present embodiment achieves the following advantages.

(1) The hydraulic mechanism 21, which employs the electromagnetic control valves 39 and 41, is always in the unloading state when the hydraulic operation device (tilt cylinder 15 and lift cylinder 16) is not operating. The pressure in the hydraulic mechanism 21 is released to the oil tank 22 in the unloading state, and thus the pressure in the hydraulic mechanism 21 is low. Therefore, when the cargo handling operation, which applies load on the engine 19, is instructed, the on-load state is set if the on-load period at this point is less than the first predetermined time (time TX), and thus the pressure in the hydraulic mechanism 21 rises. More specifically, the pressure of the hydraulic oil flowing through the supply path rises. The unloading valve 50 can subsequently enter the open state to suppress the rapid rise in the pressure in the hydraulic mechanism 21 to prevent the occurrence of an engine stall.

(2) The occurrence of an engine stall is prevented when the pressure provided to the cylinders 15 and 16 is discretely increased to control the unloading valve 50 to enter the open state. When the second predetermined time (time TY) elapses after the vehicle control device 25 causes the unloading valve 50 to enter the open state, the vehicle control device 25 causes the unloading valve 50 to enter the closed state again to set the hydraulic mechanism 21 in the on-load state, thereby increasing the pressure in the hydraulic mechanism 21 up to the pressure necessary for the operation of the cylinders 15 and 16.

(3) The vehicle control device 25 does not control the unloading valve 50 to open or close when the operation of the two cylinders 15 and 16 is instructed at the same time. More specifically, the vehicle control device 25 prohibits the control for opening or closing the unloading valve 50 when the operation of one of the cylinders 15 and 16 is instructed while the other cylinder 15 or 16 is operating. This allows the situation to be avoided in which the operation of the hydraulic operation device becomes unstable due to the fact that the unloading valve 50 can enter the open state or the closed state in response to the reception of the instruction of the operation of another hydraulic operation device.

(4) The hydraulic mechanism 21 can enter the unloading state after the end of the cargo handling operation to reduce the pressure of the hydraulic mechanism 21. This prevents the hydraulic operation device (tilt cylinder 15 and lift cylinder 16) from operating due to, for example, a wrong operation when the driver is not at the correct driving operation position.

(5) The action of the timer circuit unit discretely reduces the pressure in the hydraulic mechanism 21 after the end of the cargo handling operation. Therefore, the hydraulic operation device can be smoothly operated when the cargo handling operation is instructed again after the end of the cargo handling operation. More specifically, the timer circuit unit can maintain the pressure in the hydraulic mechanism 21 after the end of the cargo handling operation.

(6) The on-off valve 52 that mechanically opens and closes the oil passage can be used as the timer circuit unit to simplify the configuration of the hydraulic circuit. This restrains an increase in the cost of the hydraulic mechanism 21.

The above illustrated embodiment may be modified as follows.

In the above illustrated embodiment, in response to an instruction of the cargo handling operation, which applies load on the engine 19, the unloading valve 50 is controlled to enter the open state. However, load is applied to the engine 19 regardless of the instruction of the cargo handling operation in some cases. The engine rotation speed may decrease if load is applied to the engine 19. Therefore, the detection of a decrease in the engine rotation speed may be determined as a case in which load is applied to the engine 19. The unloading valve 50 may be controlled to enter the open state in response to the detection of a decrease in the engine rotation speed.

The timer circuit unit may be formed by electromagnetic valves in place of the on-off valve 52, the check valve 54, and the orifice 56. The vehicle control device 25 controls the electromagnetic valves to enter the open state after a predetermined time from the end of the cargo handling operation to reduce the pressure in the hydraulic mechanism 21.

The above illustrated embodiment may also be applied to a forklift 10 that further includes a hydraulic cylinder as a hydraulic operation device that operates an attachment.

The above illustrated embodiment may also be applied to a forklift 10 that further includes a hydraulic cylinder as a hydraulic operation device that operates a power steering mechanism.

The industrial vehicle is not limited to the forklift 10, and the industrial vehicle may be any vehicle including a hydraulic operation device such as a shovel loader.

Therefore, the present examples and embodiments are to be considered as illustrative and not restrictive and the invention is not to be limited to the details given herein, but may be modified within the scope and equivalence of the appended claims.

The invention claimed is:

1. An industrial vehicle comprising:

an engine;

a hydraulic pump driven by the engine;

a hydraulic operation device operated by oil pressure;

a connection passage that connects the hydraulic pump and the hydraulic operation device to each other;

an electromagnetic control valve that is connected to the connection passage and controls supply and drainage of hydraulic oil to and from the hydraulic operation device;

a supply passage through which the hydraulic oil supplied to the hydraulic operation device flows;

a drainage passage through which the hydraulic oil drained to an oil tank flows;

an unloading valve that connects the supply passage and the drainage passage to each other;

a relief valve that is connected to the supply passage and operated by pressure of the hydraulic oil flowing through the supply passage; and a controller that controls an open/closed state of the unloading valve, wherein, if an on-load period at the time of application of load on the engine is less than a first predetermined time, the controller performs open/close control of causing the unloading valve to enter the closed state to set an on-load state, thereby increasing the pressure of the hydraulic oil passing through the supply passage and then causing the unloading valve to enter the open state, the hydraulic operation device is one of a plurality of hydraulic operation devices, the industrial vehicle further comprises a plurality of instruction members that respectively instruct operation of the hydraulic operation devices, and the controller prohibits the open/close control when the operation of one of the hydraulic operation devices is instructed while any of the other hydraulic operation devices is operating.

2. The industrial vehicle according to claim 1, wherein, when a second predetermined time elapses after the controller causes the unloading valve to enter the open state, the controller causes the unloading valve to enter the closed state again to set the on-load state.

3. The industrial vehicle according to claim 1, further comprising a timer circuit unit that is connected to the supply passage and opens the supply passage based on elapse of time.

* * * * *